US010140928B2

(12) United States Patent
Wang et al.

(10) Patent No.: US 10,140,928 B2
(45) Date of Patent: Nov. 27, 2018

(54) PIXEL DRIVING CIRCUIT, DRIVING METHOD, ARRAY SUBSTRATE AND DISPLAY APPARATUS

(71) Applicant: BOE Technology Group Co., Ltd., Beijing (CN)

(72) Inventors: Ying Wang, Beijing (CN); Xinshe Yin, Beijing (CN); Liang Sun, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 87 days.

(21) Appl. No.: 14/771,349

(22) PCT Filed: Oct. 24, 2014

(86) PCT No.: PCT/CN2014/089456

§ 371 (c)(1),
(2) Date: Aug. 28, 2015

(87) PCT Pub. No.: WO2016/011719

PCT Pub. Date: Jan. 28, 2016

(65) Prior Publication Data

US 2016/0372049 A1 Dec. 22, 2016

(30) Foreign Application Priority Data

Jul. 22, 2014 (CN) ..... 2014 1 0350507

(51) Int. Cl.
*G09G 3/3283* (2016.01)
*G09G 3/3225* (2016.01)
*G09G 3/3233* (2016.01)

(52) U.S. Cl.
CPC ..... *G09G 3/3283* (2013.01); *G09G 3/3225* (2013.01); *G09G 3/3233* (2013.01);
(Continued)

(58) Field of Classification Search
CPC .... G09G 3/3233; G09G 3/3241; G09G 3/325; G09G 3/3258; G09G 3/3208;
(Continued)

(56) References Cited

U.S. PATENT DOCUMENTS

2005/0212446 A1* 9/2005 Eom ..... G09G 3/3233 315/169.3
2010/0073266 A1* 3/2010 Na ..... G09G 3/3233 345/76

(Continued)

FOREIGN PATENT DOCUMENTS

CN 1804977 A 7/2006
CN 1909046 A 2/2007

(Continued)

OTHER PUBLICATIONS

Apr. 28, 2015—International Search Report and Written Opinion Appn PCT/CN2014/089456 with English Tran.

(Continued)

*Primary Examiner* — Kumar Patel
*Assistant Examiner* — Amen Bogale
(74) *Attorney, Agent, or Firm* — Banner & Witcoff, Ltd.

(57) ABSTRACT

Provided are a pixel driving circuit, a driving method, an array substrate and a display apparatus. The pixel circuit comprises: a data line, a gate line, a first power line, a second power line, a reference signal line, a light emitting device, a driving transistor, a storage capacitor, a reset unit, a data writing unit, a compensation unit and a light emitting control unit. The pixel driving circuit can compensate and eliminate the display nonuniformity caused by the threshold voltage difference of the driving transistors.

19 Claims, 6 Drawing Sheets

(52) U.S. Cl.
CPC ..... *G09G 2300/043* (2013.01); *G09G 2300/0426* (2013.01); *G09G 2300/0819* (2013.01); *G09G 2300/0861* (2013.01); *G09G 2310/0251* (2013.01); *G09G 2320/0233* (2013.01); *G09G 2320/045* (2013.01); *G09G 2330/028* (2013.01)

(58) Field of Classification Search
CPC ..... G09G 3/3225; G09G 3/3291; G09G 3/30; G09G 3/32; G09G 3/3674; G09G 3/3677; G09G 3/3625; G09G 3/3648; G09G 3/3266; G09G 2300/0819; G09G 2300/0842; G09G 2300/08; G09G 2300/043; G09G 2300/0465; G09G 2300/0861; G09G 2300/0852; G09G 2300/0876; G09G 2300/0847; G09G 2300/0439; G09G 2310/0256; G09G 2310/0262; G09G 2310/0251; G09G 2310/0243; G09G 2320/043; G09G 2320/045; G09G 2320/0233; G09G 2320/04; G09G 2320/0286; G09G 2320/02
See application file for complete search history.

(56) References Cited

U.S. PATENT DOCUMENTS

2010/0265237 A1* 10/2010 Tsuge ..... G09G 3/3233 345/211
2011/0084947 A1* 4/2011 Chung ..... G09G 3/3233 345/211
2011/0122119 A1 5/2011 Bae et al.
2011/0141000 A1* 6/2011 Han ..... G09G 3/3233 345/82
2011/0193855 A1* 8/2011 Han ..... G09G 3/3233 345/214
2011/0193856 A1* 8/2011 Han ..... G09G 3/3233 345/214
2012/0235972 A1 9/2012 Liu et al.
2013/0127815 A1 5/2013 Yoo
2014/0111563 A1* 4/2014 Hwang ..... G09G 3/003 345/691
2014/0132162 A1* 5/2014 Kim ..... G09G 3/3266 315/161
2014/0168180 A1* 6/2014 Kim ..... H05B 33/0896 345/205
2014/0176404 A1* 6/2014 Qian ..... G09G 3/3258 345/82
2014/0225878 A1* 8/2014 Shih ..... G09G 3/3258 345/205
2014/0333515 A1* 11/2014 In ..... G09G 3/3233 345/82

FOREIGN PATENT DOCUMENTS

CN 1918617 A 2/2007
CN 101097680 A 1/2008
CN 101256739 A 9/2008
CN 101276546 A 10/2008
CN 101281723 A 10/2008
CN 101345022 A 1/2009
CN 101556762 A 10/2009
CN 102074189 A 5/2011
CN 102194408 A 9/2011
CN 102339586 A 2/2012
CN 102820001 A 12/2012
CN 102881255 A 1/2013
CN 102930824 A 2/2013
CN 103077680 A 5/2013

OTHER PUBLICATIONS

Nov. 30, 2015—(CN)—First Office Action Appn 201410350507.X with English Tran.
Mar. 16, 2016—(CN)—Second Office Action Appn 201410350507.X with English Tran.
Fundamentals of Electrical Engineering, Sep. 30, 1997, pp. 1-10, with English Tran.

* cited by examiner

PIXEL DRIVING CIRCUIT, DRIVING METHOD, ARRAY SUBSTRATE AND DISPLAY APPARATUS

The application is a U.S. National Phase Entry of International Application No. PCT/CN2014/089456 filed on Oct. 24, 2014, designating the United States of America and claiming priority to Chinese Patent Application No. 201410350507.X filed on Jul. 22, 2014. The present application claims priority to and the benefit of the above-identified applications and the above-identified applications are incorporated by reference

TECHNICAL FIELD OF THE DISCLOSURE

The present disclosure relates to a pixel driving circuit, a driving method, an array substrate and a display apparatus.

BACKGROUND

Organic light emitting diode (OLED) which functions as a current type light emitting device has increasingly been applied to high performance active matrix organic light emitting diodes. Regarding a traditional passive matrix OLED, as its display size increases, a shorter driving time for a single pixel is needed and thus there is a need to increase the transient current, which increases the power consumption. Meanwhile, the application of large current may cause too large voltage drop in the ITO (Indium Tin Oxide) line, and cause the operating voltage of the OLED to be too high, and thus its efficiency would be lowered. Whereas regarding an AMOLED (Active Matrix OLED), the OLED current is input with a line by line scan of switch transistors, and these problems may be resolved.

In the design of the pixel circuit of the AMOLED, the main problem to be solved is the brightness nonuniformity of OLED devices driven by various AMOLED pixel driving units.

First, AMOLED uses TFTs (Thin Film Transistors) to construct a pixel driving circuit to provide corresponding driving current for the light emitting device. Generally, low temperature polycrystal silicon TFTs or Oxide TFTs are mostly used. Compared with a general amorphous silicon TFT, the low temperature polycrystal silicon TFT and the Oxide TFT have larger mobility and more stable characteristics, and are more suitable for be applied to AMOLED display. However, due to the limitation of crystallization process, the low temperature polycrystal silicon TFTs fabricated on a large area glass substrate usually have nonuniformity on electrical parameters such as threshold voltage, mobility and so on. Such nonuniformity will be converted to differences among the driving currents and brightnesses of the OLED devices which can be perceived by human eyes, i.e., a mura phenomenon. Although the Oxide TFT has good uniformity in terms of process, similar to the amorphous silicon TFT, its threshold voltage will drift when voltage and high temperature are applied for a long time. TFTs in different parts of the panel have different threshold drift amount due to different display pictures, which would cause display brightness difference. Because this difference is related to the picture displayed previously, it is usually presented as an afterimage phenomenon.

Since the light emitting device of the OLED is a current driven device, in the pixel driving unit for driving the light emitting device to emit light, the influence of the threshold characteristic of the driving transistor on the driving current and the final display brightness is great. Both the voltage stress and the illumination subjected by the driving transistor cause its threshold to drift, and such a threshold drift may be embodied as the brightness nonuniformity in the displaying effect.

In addition, in order to eliminate the influence caused by the threshold voltage difference of the driving transistors, in the pixel circuit of a common AMOLED, the structure of the pixel circuit is usually designed with higher complexity, which will result in the reduction of the fabrication yield for the pixel circuit of the AMOLED.

The present disclosure provides a pixel driving unit and a driving method thereof, and a pixel circuit.

SUMMARY

At least one embodiment of the present disclosure is to implement an AMOLED pixel driving circuit capable of compensating and eliminating the display nonuniformity caused by the threshold voltage difference of the driving transistors.

In accordance with one aspect of the present disclosure, there is provided a pixel driving circuit comprising: a data line, a gate line, a first power line, a second power line, a reference signal line, a light emitting device, a driving transistor, a storage capacitor, a reset unit, a data writing unit, a compensation unit and a light emitting control unit; wherein the data line is configured to provide a data voltage;

the gate line is configured to provide a scanning voltage;

the first power line is configured to provide a first power voltage, the second power line is configured to provide a second power voltage, and the reference signal line is configured to provide a reference voltage;

the reset unit is connected with the storage capacitor, and the reset unit is configured to reset the voltage across the storage capacitor to a predetermined signal voltage;

the data writing unit is connected with the gate line, the data line and a second terminal of the storage capacitor, and the data writing unit is configured to write information comprising the data voltage to the second terminal of the storage capacitor;

the compensation unit is connected with a first terminal of the storage capacitor and the driving transistor, and the compensation unit is configured to write information comprising the threshold voltage of the driving transistor and the first power voltage to the first terminal of the storage capacitor;

the light emitting control unit is connected with the reference signal line, the second terminal of the storage capacitor, the driving transistor and the light emitting device, and the light emitting control unit is configured to write the reference voltage to the second terminal of the storage capacitor;

the first terminal of the storage capacitor is connected with a gate of the driving transistor, and the storage capacitor is configured to transfer information comprising the data voltage to the gate of the driving transistor;

the driving transistor is connected with the first power line, the light emitting device is connected with the second power line, and the driving transistor is configured to drive the light emitting device to emit light.

The reset unit is also connected with the first power line, and the reset unit comprises a reset control line, a reset signal line, a first transistor and a second transistor. A gate of the first transistor is connected with the reset control line, a source of the first transistor is connected with the reset signal line, a drain of the first transistor is connected with the first terminal of the storage capacitor, and the first transistor is configured to write the voltage of the reset signal line to the first terminal of the storage capacitor; and a gate of the second transistor is connected with the reset control line, a source of the second transistor is connected with the first power line, q drain of the second transistor is connected with the second terminal of the storage capacitor, and the second transistor is configured to write the first power voltage to the second terminal of the storage capacitor.

Both the first transistor and the second transistor are P type transistors.

The data writing unit comprises a fourth transistor. A gate of the fourth transistor is connected with the gate line, a source of the fourth transistor is connected with the data line, a drain of the fourth transistor is connected with the second terminal of the storage capacitor, and the fourth transistor is configured to write the data voltage to the second terminal of the storage capacitor.

The fourth transistor is a P type transistor.

The compensation unit is also connected with the gate line, and the compensation unit comprises a third transistor. A gate of the third transistor is connected with the gate line, a source of the third transistor is connected with the first terminal of the storage capacitor, a drain of the third transistor is connected with a drain of driving transistor, and the third transistor is configured to write information comprising the threshold voltage of the driving transistor and the first power voltage to the first terminal of the storage capacitor.

The third transistor is a P type transistor.

The light emitting control unit comprises a light emitting control line, a fifth transistor and a sixth transistor. A gate of the fifth transistor is connected with the light emitting control line, a source of the fifth transistor is connected with the reference signal line, a drain of the fifth transistor is connected with the second terminal of the storage capacitor, and the fifth transistor is configured to write the reference voltage to the second terminal of the storage capacitor, and the reference voltage is transferred to the gate of the driving transistor by the storage capacitor; a gate of the sixth transistor is connected with the light emitting control line, a source of the sixth transistor is connected with a first terminal of the light emitting device, a drain of the sixth transistor is connected with the drain of the driving transistor, and the sixth transistor is configured to control the light emitting device to emit light. The driving transistor is configured to drive the light emitting device to emit light under the control of the light emitting control unit.

The driving transistor, the fifth transistor and the sixth transistor are P type transistors.

The reference signal line and the first power line are arranged to be parallel with each other.

The width of the first power line is greater than that of the reference signal line.

The reset signal line and the first power line are arranged to be parallel with each other.

The width of the first power line is greater than that of the reset signal line.

In accordance with another aspect of the present disclosure, there is provided a driving method for the pixel driving circuit as described above, comprising the following steps:

during a reset phase, the reset unit resets the voltage across the storage capacitor to a predetermined voltage;

during a data voltage writing phase, the data writing unit writes the data voltage and the compensation unit writes the information comprising the threshold voltage of the driving transistor and the first power voltage to the two terminals of the storage capacitor respectively; and during a light emitting phase, the driving transistor drives the light emitting device to emit light under the control of the light emitting control unit.

During the reset phase, the reset unit resets the voltage of the first terminal of the storage capacitor to the voltage of the reset signal line, and the reset unit resets the voltage of the second terminal of the storage capacitor to the first power voltage.

During the data voltage writing phase, the data writing unit writes the data voltage to the second terminal of the storage capacitor, and the compensation unit writes information comprising the threshold voltage of the driving transistor and the first power voltage to the first terminal of the storage capacitor.

The light emitting control unit writes the reference voltage to the second terminal of the storage capacitor, the storage capacitor transfers information comprising the data voltage and the reference voltage to the gate of the driving transistor, and the driving transistor drives the light emitting device to emit light under the control of the light emitting control unit.

In accordance with yet another aspect of the present disclosure, there is also provided an array substrate comprising the pixel driving circuit as described above.

In accordance with yet another aspect of the present disclosure, there is also provided a display apparatus comprising the array substrate as described above.

In the pixel driving unit according to at least one embodiment of the present disclosure, with the structure in which the gate and the drain of the driving transistor are connected (when the gate control signal is turned on, the gate and the drain of the driving transistor are connected through the third switch transistor), the first power voltage along with the threshold voltage of the driving transistor is loaded to the first terminal of the storage capacitor by the drain of the driving transistor, and thus the threshold voltage of the driving transistor is counteracted; during the process of driving the light emitting device, the nonuniformity caused by the driving transistor due to its own threshold voltage and the afterimage phenomenon caused by the threshold voltage drift may be eliminated effectively, thus avoiding the problem of brightness nonuniformity of AMOLED caused by the light emitting devices of different pixel driving units of the AMOLED due to the threshold voltage difference of the driving transistors for the light emitting devices. The driving effect of the pixel driving unit on the light emitting device is improved, and the quality of AMOLED is further improved.

DETAILED DESCRIPTION

Hereinafter, the detailed description of implementations of the present disclosure will be described in further detail with reference to the drawings and the embodiments. The following embodiments are used to illustrate the present disclosure but not to limit the scope of the present disclosure.

It should be noted that, the gate of each transistors defined in embodiments of the present disclosure is a terminal for controlling the transistor to be turned on, and the source and the drain are two terminals except the gate; herein the source and the drain are only for convenience of explanation regarding the connection relationships of the transistors but not to limit the direction of the current; and to those skilled in the art, the operating principle and the state of a transistor may be obvious based on information such as the type of the transistor, and the connection ways of the signals.

Figure 1:
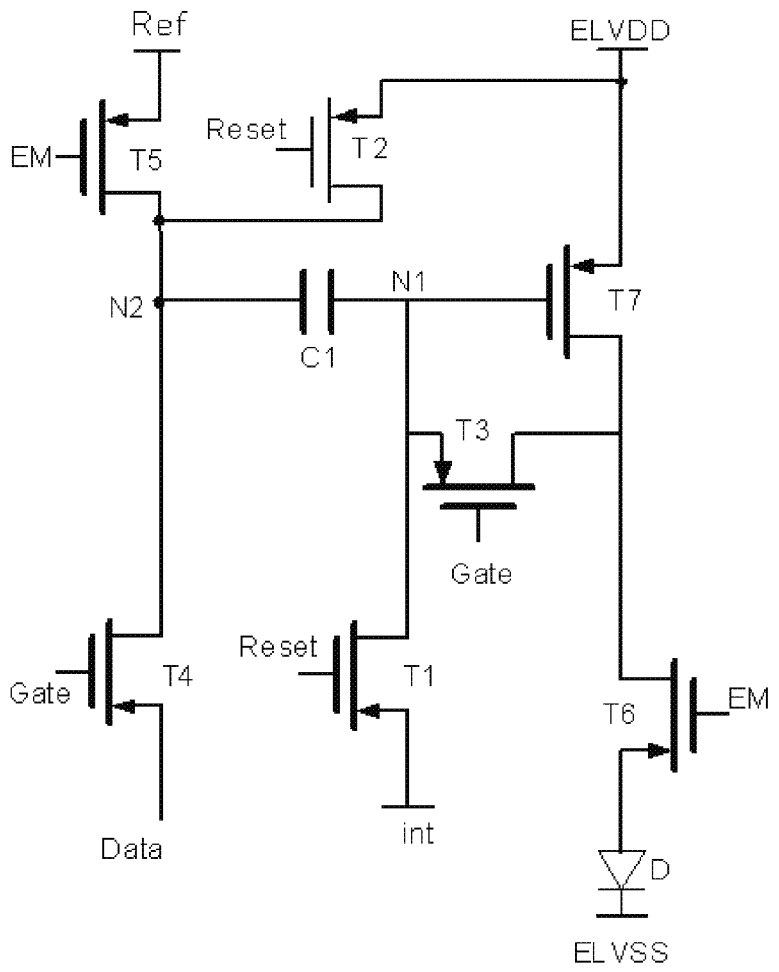
FIG. 1 is a diagram of a pixel driving circuit according to an embodiment of the present disclosure.

FIG. 1 is a diagram of a pixel driving circuit according to an embodiment of the present disclosure. As shown in FIG. 1, the pixel driving circuit comprises a data line Data, a gate line Gate, a first power line ELVDD, a second power line ELVSS, a reference signal line Ref, a light emitting device D, a driving transistor T7, a storage capacitor C1, a reset unit, a data writing unit, a compensation unit and a light emitting control unit. The data line Data is configured to provide a data voltage, the gate line Gate is configured to provide a scanning voltage, the first power line ELVDD is configured to provide a first power voltage, the second power line ELVSS is configured to provide a second power voltage, and the reference signal line Ref is configured to provide a reference voltage. The first power voltage is a high voltage for driving the light emitting device to emit light, the second power voltage is a low voltage for driving the light emitting device to emit light, and the reference voltage is a high voltage for achieving compensation effect when the pixel circuit is being driven.

The Light emitting device D may be an organic light emitting diode. A gate of the driving transistor T7 is connected with a first terminal N1 of the storage capacitor C1, a source of the driving transistor T7 is connected with the first power line ELVDD, and a drain of the driving transistor T7 is connected with light emitting control unit.

The reset unit comprises a reset control line Reset, a reset signal line int, a first transistor T1 and a second transistor T2. The reset unit is connected with the storage capacitor C1, and the reset unit is configured to reset the voltage across the storage capacitor C1 to a predetermined voltage.

The data writing unit comprises a fourth transistor T4. The data writing unit is connected with the gate line Gate, the data line Data and a second terminal N2 of the storage capacitor C1, and the data writing unit is configured to write information comprising the data voltage to the second terminal N2 of the storage capacitor C1.

The compensation unit comprises a third transistor T3. The compensation unit is connected with the first terminal N1 of the storage capacitor C1 and the driving transistor T7, and the compensation unit is configured to write information comprising the threshold voltage of the driving transistor and the first power voltage to the first terminal N1 of the storage capacitor C1.

The light emitting control unit comprises a light emitting control line EM, a fifth transistor T5 and a sixth transistor T6. The light emitting control unit is connected with the reference signal line Ref, the second terminal N2 of the storage capacitor C1, the driving transistor T7 and the light emitting device D, and the light emitting control unit is configured to write the reference voltage to the second terminal N2 of the storage capacitor C1.

The first terminal N1 of the storage capacitor C1 is connected with the gate of the driving transistor T7, and the storage capacitor C1 is configured to transfer information comprising the data voltage to the gate of the driving transistor T7.

The driving transistor T7 is connected with the first power line ELVDD, the light emitting device D is connected with the second power line ELVSS, and the driving transistor T7 is configured to drive the light emitting device D to emit light.

In the driving circuit according to the present embodiment, the threshold voltage of the driving transistor is taken by the compensation unit and the threshold voltage of the driving transistor T7 can be counteracted in the process that the light emitting device is being driven, and thereby the nonuniformity caused by the driving transistor due to its own threshold voltage and the afterimage phenomenon caused by the threshold voltage drift may be eliminated effectively, thus avoiding the problem of brightness nonuniformity of different pixels in AMOLED devices due to the threshold voltage difference of the driving transistors thereof.

Figure 2A:
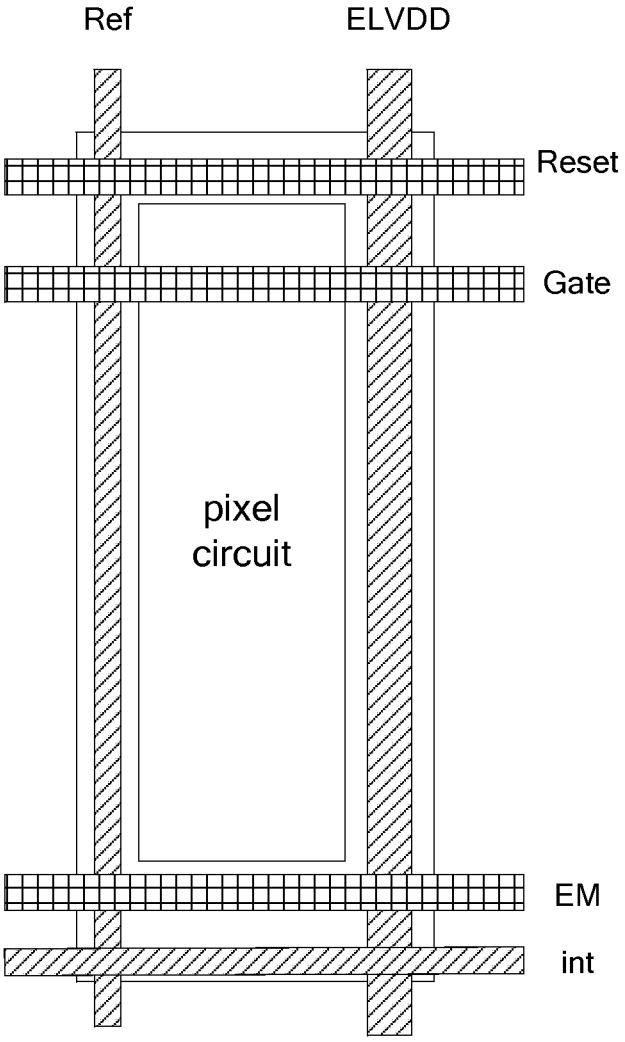
FIG. 2*a* is a schematic diagram of a pixel structure (in which only one pixel is shown) according to an embodiment of the present disclosure.
Figure 2B:
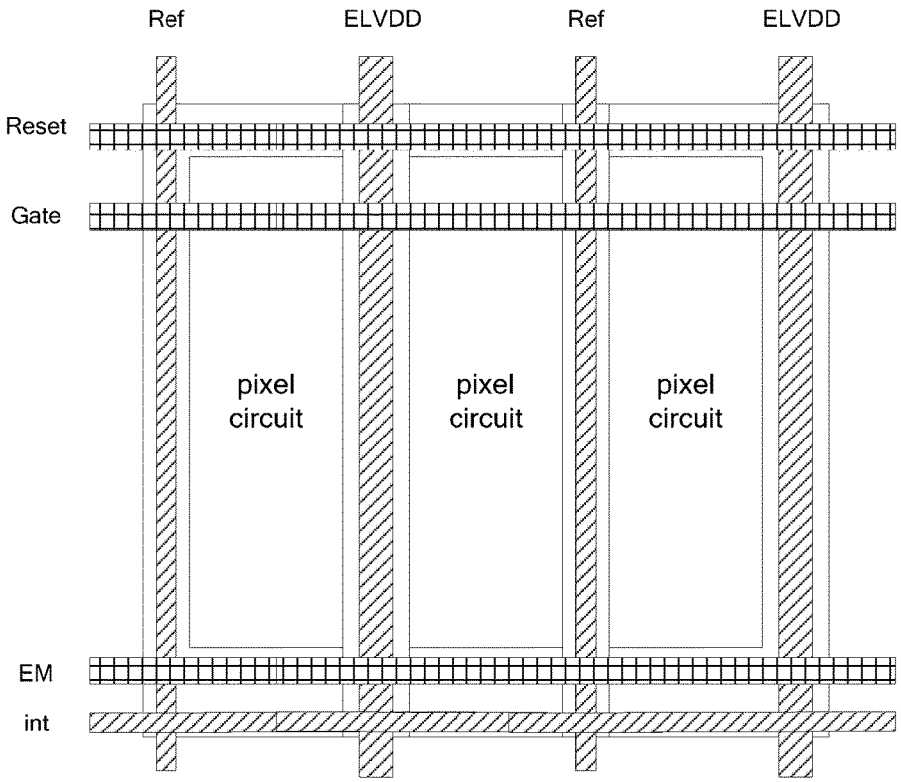
FIG. 2*b* is a diagram of a pixel structure in which a plurality of pixels shown in FIG. 2*a* are included.

FIG. 2*a* is a schematic diagram of a pixel structure (in which only one pixel is shown) according to an embodiment of the present disclosure, and FIG. 2*b* is a diagram of a pixel structure in which a plurality of pixels shown in FIG. 2*a* are included. The light emitting control unit writes the reference voltage to the second terminal N2 of the storage capacitor C1, and as shown in FIG. 2*a*, the reference voltage is transmitted by the reference signal line Ref separated from the first power line ELVDD. For example, the first power line ELVDD and the reference signal line Ref may be arranged to be parallel with each other. During the driving process, the current in the reference signal line Ref is small and the voltage drop is also small; the storage capacitor is connected with the gate of the driving transistor; since the reference voltage is relatively stable with respect to the first power voltage, the gate-source voltage of the driving transistor is also stable, and thus the problem of brightness nonuniformity of different pixels which is caused by the influence of the first power voltage drop on the current may be avoided. Simultaneously, the pixel structure may also minimize the influence of the change in the direct current in the reference signal line Ref on the display uniformity. As shown in FIG. 2*b*, the pixel structure may also achieve the purpose of enabling adjacent pixels to share the reference signal line Ref and the first power line ELVDD, i.e., the pixels in two adjacent columns share one reference signal line Ref and the pixels in two adjacent columns share one first power line ELVDD, as shown in FIG. 2*b*. Based on the operating principle of the pixel, since the current in the reference signal line Ref is very small, a small line width may be employed as the width of the reference signal line Ref (the small line width means that the width of the reference signal line Ref is less than the width of the first power line ELVDD), and thereby the area occupied by the pixel driving circuit is minimized and the aperture ratio can be improved. In order to reduce the voltage drop in each of the lines, the reference signal line Ref and the first power line ELVDD are usually metal wires and are arranged longitudinally and to be parallel with each other. Based on the requirements for the layout of the pixel structure, the light emitting control line EM, the reset control line Reset, and the reset signal line int may be arranged as transversal routings, i.e., arranged to be parallel with the gate line Gate, and they may be arranged on one side or the other side of the gate line Gate in the pixel area.

Figure 3A:
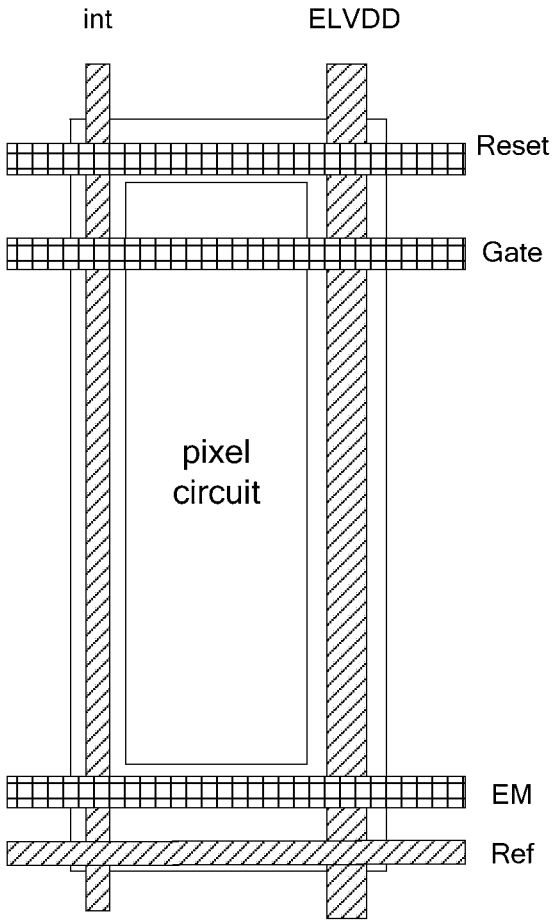
FIG. 3*a* is a schematic diagram of another pixel structure according to an embodiment of the present disclosure.
Figure 3B:
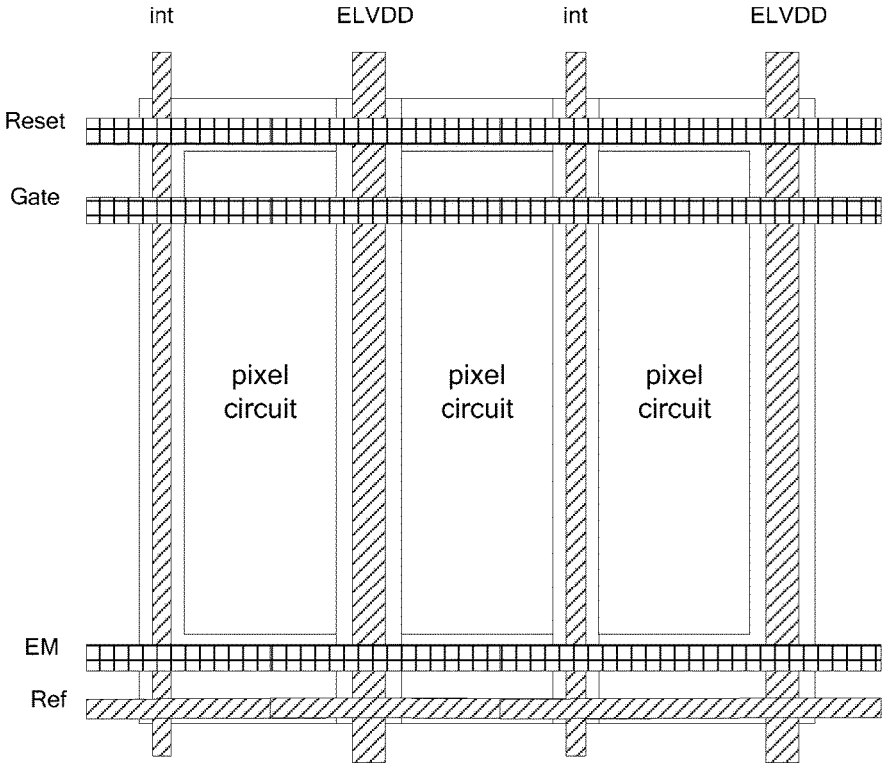
FIG. 3*b* is a diagram of a pixel structure in which a plurality of pixels shown in FIG. 3*a* are included.

In addition, the layout of a pixel in practice may also be as shown in FIG. 3*a* and FIG. 3*b*. FIG. 3*a* is schematic diagram of another pixel structure according to an embodiment of the present disclosure, and FIG. 3*b* is a diagram of a pixel structure in which a plurality of pixels shown in FIG. 3*a* are included. As shown in FIG. 3*a*, a transversal routing is employed for the reference signal line Ref, i.e., the reference signal line Ref is substantially parallel with the gate line Gate, while a vertical routing is employed for the reset signal line int, i.e., the reset signal line int is substantially parallel with the first power line ELVDD. As shown in FIG. 3*b*, it is also possible that the reset signal line int and the first power line ELVDD are shared by the adjacent pixels (the pixels in two adjacent columns share one reset signal line int and the pixels in two adjacent columns share one first power line ELVDD). A routing which has a width less than that of the first power line ELVDD may also be employed for the reset signal line int, so that the area occupied by the driving circuit is decreased and the aperture ratio is improved. Further, in order to reduce the voltage drop in each of the lines, metal wires are usually employed for the first power line ELVDD and the reference signal line Ref. Meanwhile, for the requirements for the layout of the pixel structure, the light emitting control line EM and the reset control line Reset may also be arranged as transversal routings, i.e., arranged to be parallel with the gate line Gate, and they may arranged on one side or the other side of the gate line Gate in the pixel area. It should be noted that FIG. 2*a*, FIG. 2*b*, FIG. 3*a* and FIG. 3*b* are only illustration for a pixel structure but not a limitation to the pixel structure, and other layouts may be employed in practical design.

In the present embodiment, the reset unit is also connected with the first power line ELVDD. The reset unit comprises a reset control line Reset, a reset signal line int, a first transistor T1 and a second transistor T2. A gate of the first transistor T1 is connected with the reset control line Reset, a source of the first transistor T1 is connected with the reset signal line int, a drain of the first transistor T1 is connected with the first terminal of the storage capacitor C1, and the first transistor T1 is configured to write the voltage $V_{int}$ of the reset signal line int to the first terminal of the storage capacitor C1. A gate of the second transistor T2 is connected with the reset control line Reset, a source of the second transistor T2 is connected with the first power source line ELVDD, a drain of the second transistor T2 is connected with the second terminal of the storage capacitor C1, and the second transistor T2 is configured to write the first power voltage $V_{dd}$ to the second terminal of the storage capacitor C1. That is, the voltages at the two terminals of C1 are reset to $V_{int}$ and $V_{dd}$ respectively. The first power voltage $V_{dd}$ is a DC power supply signal which functions as a reset signal for resetting the storage capacitor C1 and has a strong signal driving capability which enable it to complete the action of the resetting in a short reset period. Besides, during the reset process, since the signal for resetting the second terminal of the storage capacitor with which the source of the second transistor T2 is connected will generate a charging current for the storage capacitor C1, and this current occurs in the reset phase for each row, one pulsating DC may be formed and a DC voltage drop may be formed on the reset signal due to the pulsating DC. In the embodiments of the present disclosure, when the voltage signal of first power line ELVDD i.e., the first power voltage $V_{dd}$ is employed as the reset signal, there may be a DC voltage drop during the reset period; however, since the structure of the pixel circuit itself has the function of compensating the DC voltage drop of the first power voltage $V_{dd}$ (please see the following equation (1)), even if there is a DC voltage drop in the first power line ELVDD caused by the pulsating DC during the reset phase, it may be compensated and the display effect will not be influenced. Therefore, a better display uniformity may be obtained if the second terminal of the storage capacitor C1 is reset with the voltage signal of first power line ELVDD, i.e., the first power voltage $V_{dd}$.

The data writing unit comprises a fourth transistor T4. A gate of the fourth transistor T4 is connected with the gate line Gate, a source of the fourth transistor T4 is connected with the data line Data, a drain of the fourth transistor T4 is connected with the second terminal of the storage capacitor C1, and the fourth transistor T4 is configured to write the data voltage $V_{data}$ to the second terminal of the storage capacitor. That is, causing the voltage at terminal N2 to be $V_{data}$.

The compensation unit is also connected with the gate line Gate, the compensation unit comprises a third transistor T3. A gate of the third transistor T3 is connected with the gate line Gate, a source of the third transistor T3 is connected with the first terminal of the storage capacitor C1, a drain of the third transistor T3 is connected with the drain of driving transistor T7, and the third transistor T3 is configured to write information comprising the threshold voltage $V_{th}$ of the driving transistor T7 and the first power voltage to the first terminal of the storage capacitor C1, that is, the voltage at terminal N1 is $V_{dd}-V_{th}$, wherein $V_{th}$ is the threshold voltage of the driving transistor T7.

The light emitting control unit comprises a light emitting control line EM, a fifth transistor T5 and a sixth transistor T6. A gate of the fifth transistor T5 is connected with the light emitting control line EM, a source of the fifth transistor T5 is connected with the reference signal line Ref, a drain of the fifth transistor T5 is connected with the second terminal of the storage capacitor C1, and the fifth transistor T5 is configured to write the reference voltage $V_{Ref}$ to the second terminal of the storage capacitor C1, and the reference voltage is transferred to the gate of the driving transistor T7 by the storage capacitor C1. A gate of the sixth transistor T6 is connected with the light emitting control line EM, a source of the sixth transistor T6 is connected with the first terminal of the light emitting device D, a drain of the sixth transistor T6 is connected with the drain of the driving transistor T7, and the sixth transistor T6 is configured to control the light emitting device D to emit light, that is, the driving transistor T7 can make the driving current flow to the light emitting device D only if T6 is turned on. The driving transistor drives the light emitting device D to emit light under the control of the light emitting control unit.

Figure 4:
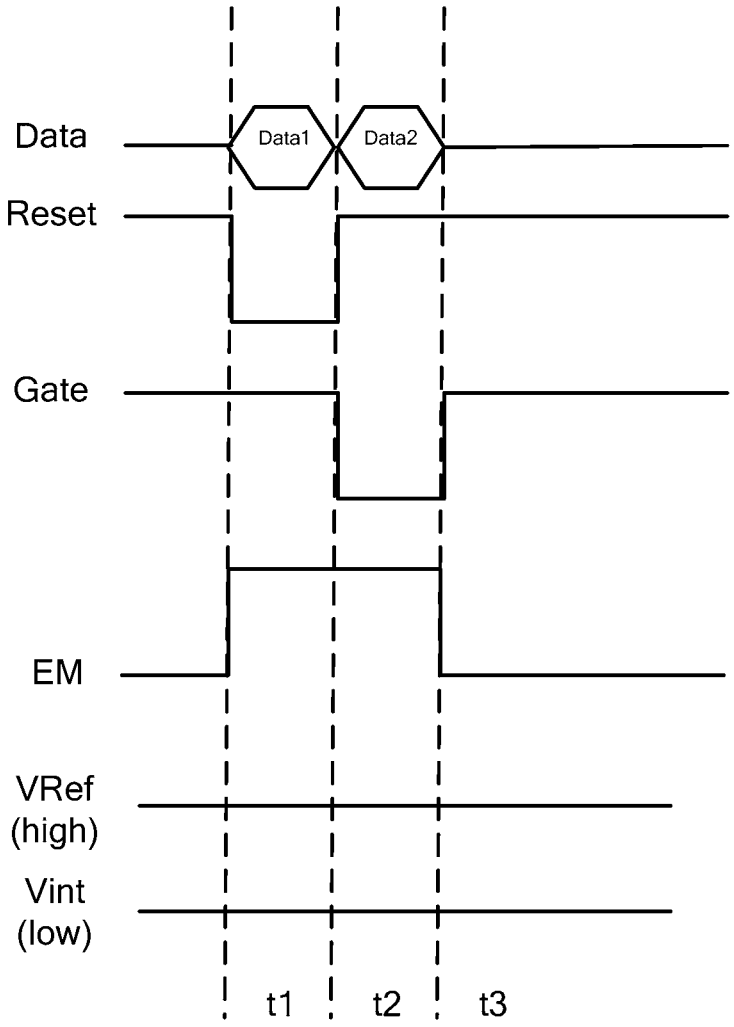
FIG. 4 is a time sequence diagram of the pixel driving circuit shown in FIG. 1.

The following description will be made by taking a case where the transistors as described above are P type transistors. FIG. 4 is a time sequence diagram of the pixel driving circuit shown in FIG. 1. As shown in FIG. 4, there are three phases when the circuit structure of the present embodiment operates:

A first phase t1: the signal of the reset control line Reset is valid, and T1 and T2 are turned on, and the two terminals of the storage capacitor C1 are reset. In this situation, terminal N1 is written with the voltage $V_{int}$ of the reset signal line int, wherein $V_{int}$ is a low voltage for achieving the reset effect, and terminal N2 is at the reference voltage $V_{dd}$.

A second phase t2: the signal of the gate line Gate is valid so that T3, T4 are turned on, and terminal N2 is written with $V_{data}$, and terminal N1 is written with $V_{dd}-V_{th}$, and in this situation, the voltage stored by the storage capacitor C1 is $V_{dd}-V_{th}-V_{data}$. During this phase, information comprising the first power voltage and the threshold voltage of the driving transistor is written to the first terminal of the storage capacitor C1 by T3.

A third phase t3: the signal of the light emitting control line EM is valid, and T5,T6 are turned on, T5 is connected with the reference signal line Ref, and the electric potential of terminal N2 is $V_{Ref}$, wherein $V_{Ref}$ is a high voltage for achieving the compensation effect, and the electric potential of terminal N1 is $V_{dd}-V_{th}-V_{data}+V_{Ref}$, which is the electric potential of the gate of the driving transistor. The electric potential of the source of the driving transistor is $V_{dd}$, and the gate-source voltage $V_{gs}$ is equal to $V_{dd}-V_{th}-V_{data}+V_{Ref}-V_{dd}$, and the current which flows to the light emitting device is:

$$I=\tfrac{1}{2}\mu C_{ox}(W/L)(V_{gs}-V_{th})^2=\tfrac{1}{2}\mu C_{ox}(W/L)(V_{Ref}-V_{data})^2 \quad (1)$$

where μ is the carrier mobility, $C_{ox}$ is capacitance of the gate oxide layer, and W/L is the aspect ratio of the driving transistor.

As can be seen from the above equation for the current flowing to the light emitting device, the current I has already been independent of the threshold voltage $V_{th}$ of the driving transistor T7, and therefore the problem of display brightness nonuniformity caused by different pixels in AMOLED device due to the threshold voltage difference of the driving transistors for respective pixels is avoided. The current I is also independent of $V_{dd}$, and only the storage capacitor is charged by $V_{Ref}$, and thus the current in the corresponding line is small and the voltage drop is also small; the storage capacitor is connected with the gate of the driving transistor, since $V_{Ref}$ is relatively stable with respect to $V_{dd}$, the gate-source voltage of the driving transistor is also stable, and thus the problem of brightness nonuniformity of different pixels which is caused by the influence of $V_{dd}$ drop on the current may be avoided.

The driving transistor, the first transistor, the second transistor, the third transistor, the fourth transistor, the fifth transistor, and the sixth transistor in the above embodiments are all P type transistors. Of course, each of them may be a N type transistor or they may be combinations of P type transistors and N type transistors but with the difference that the valid signals of the gate control signal lines may be different.

An embodiment of the present disclosure provides a driving method for the pixel driving circuit as described above comprising the following steps:

During a reset phase, the reset unit resets the voltage across the storage capacitor to a predetermined voltage. Particularly, the reset unit resets the voltage of the first terminal of the storage capacitor to the voltage of the reset signal line, and the reset unit resets the voltage of the second terminal of the storage capacitor to the first power voltage.

During a data voltage writing phase, the data writing unit writes the data voltage and the compensation unit writes the information comprising the threshold voltage of the driving transistor and the first power voltage to the two terminals of the storage capacitor respectively. Particularly, the data writing unit writes the data voltage to the second terminal of the storage capacitor, and the compensation unit writes information comprising the threshold voltage of the driving transistor and the first power voltage to the first terminal of the storage capacitor.

During a light emitting phase, the driving transistor drives the light emitting device to emit light under the control of the light emitting control unit. Particularly, the light emitting control unit writes the reference voltage to the second terminal of the storage capacitor, the storage capacitor transfers information comprising the data voltage and the reference voltage to the gate of the driving transistor, and the driving transistor drives the light emitting device to emit light under the control of the light emitting control unit.

Please see the presentation of the three operating phases in the above embodiment for the specific driving steps which will not be repeated here.

The present embodiment provides an array substrate comprising the pixel driving circuit as described above.

The present embodiment provides a display apparatus comprising the array substrate as described above. The display apparatus may be any product or component with display function, such as a AMOLED panel, a television, a digital photo frame, a cell phone, and a tablet, and so on.

The above implementations are only used to illustrate the present disclosure but not to limit the present disclosure, and various changes and modifications can also be made by the ordinary skilled man in a relevant technical field without departing from the spirit and the scope of the present disclosure; and therefore all the equivalent technical solutions also fall within the scope of the present disclosure, and the protection scope of the present disclosure should be defined by the claims.

The present application claims the priority of Chinese Patent Application No. 201410350507.X filed on Jul. 22, 2014, entire content of which is incorporated as part of the present invention by reference

What is claimed is:

1. A pixel driving circuit, comprising: a data line, a gate line, a first power line, a second power line, a reference signal line, a light emitting device, a driving transistor, a storage capacitor, a reset subcircuit, a data writing subcircuit, a compensation subcircuit and a light emitting control subcircuit, wherein:

the data line is configured to provide a data voltage;

the gate line is configured to provide a scanning voltage;

the first power line is configured to provide a first power voltage, the second power line is configured to provide a second power voltage, and the reference signal line is configured to provide a reference voltage;

the reset subcircuit is connected with two terminals of the storage capacitor, and also with the first power line, and the reset subcircuit is configured to reset a voltage across the two terminals of the storage capacitor to a predetermined signal voltage;

the data writing subcircuit is connected with the gate line, the data line and a second terminal of the storage capacitor, and the data writing subcircuit is configured to write information comprising the data voltage to the second terminal of the storage capacitor, the compensation subcircuit is connected with a first terminal of the storage capacitor and the driving transistor, and the compensation subcircuit is configured to write information comprising a threshold voltage of the driving transistor and the first power voltage to the first terminal of the storage capacitor;

the light emitting control subcircuit is connected with the reference signal line, the second terminal of the storage capacitor, the driving transistor and the light emitting device, and the light emitting control subcircuit is configured to write the reference voltage to the second terminal of the storage capacitor;

the first terminal of the storage capacitor is connected with a gate of the driving transistor, and the storage capacitor is configured to transfer information comprising the data voltage to the gate of the driving transistor; and the driving transistor is connected with the first power line, the light emitting device is connected with the second power line, and the driving transistor is configured to drive the light emitting device to emit light, wherein the reset subcircuit comprises a reset control line, a reset signal line, a first transistor and a second transistor, a gate of the first transistor and a gate of the second transistor are both connected with the reset control line, a source of the first transistor is connected with the reset signal line, a drain of the first transistor is connected with the first terminal of the storage capacitor, a source of the second transistor is connected with the first power line, a drain of the second transistor is connected with the second terminal of the storage capacitor, and the first transistor and the second transistor are respectively configured to write the voltage of the reset signal line to the first terminal of the storage capacitor and to write the first power voltage to the second terminal of the storage capacitor both under control of the reset control line, wherein the reset signal line, the first power line and the reference signal line are three different signal lines, and the voltage of the reset signal line is a low voltage and is different from the first power voltage of the first power line and is different from the reference voltage of the reference signal line.

2. The pixel driving circuit according to claim 1, wherein both the first transistor and the second transistor are P type transistors.

3. The pixel driving circuit according to claim 1, wherein the data writing subcircuit comprises a fourth transistor, a gate of the fourth transistor is connected with the gate line, a source of the fourth transistor is connected with the data line, a drain of the fourth transistor is connected with the second terminal of the storage capacitor, and the fourth transistor is configured to write the data voltage to the second terminal of the storage capacitor.

4. The pixel driving circuit according to claim 3, wherein the fourth transistor is a P type transistor.

5. The pixel driving circuit according to claim 1, wherein the compensation subcircuit is also connected with the gate line, and the compensation subcircuit comprises a third transistor, a gate of the third transistor is connected with the gate line, a source of the third transistor is connected with the first terminal of the storage capacitor, a drain of the third transistor is connected with a drain of driving transistor, and the third transistor is configured to write information comprising the threshold voltage of the driving transistor and the first power voltage to the first terminal of the storage capacitor.

6. The pixel driving circuit according to claim 5, wherein the third transistor is a P type transistor.

7. The pixel driving circuit according to claim 1, wherein the light emitting control subcircuit comprises a light emitting control line, a fifth transistor and a sixth transistor; a gate of the fifth transistor is connected with the light emitting control line, a source of the fifth transistor is connected with the reference signal line, a drain of the fifth transistor is connected with the second terminal of the storage capacitor, and the fifth transistor is configured to write the reference voltage to the second terminal of the storage capacitor, and the reference voltage is transferred to the gate of the driving transistor by the storage capacitor; a gate of the sixth transistor is connected with the light emitting control line, a source of the sixth transistor is connected with a first terminal of the light emitting device, a drain of the sixth transistor is connected with the drain of the driving transistor, and the sixth transistor is configured to control the light emitting device to emit light; and the driving transistor is configured to drive the light emitting device to emit light under the control of the light emitting control subcircuit.

8. The pixel driving circuit according to claim 7, wherein the driving transistor, the fifth transistor and the sixth transistor are P type transistors.

9. The pixel driving circuit according to claim 1, wherein the reference signal line and the first power line are arranged to be parallel with each other.

10. The pixel driving circuit according to claim 9, wherein a width of the first power line is greater than that of the reference signal line.

11. The pixel driving circuit according to claim 1, wherein the reset signal line and the first power line are arranged to be parallel with each other.

12. The pixel driving circuit according to claim 11, wherein a width of the first power line is greater than that of the reset signal line.

13. A method for driving a pixel driving circuit, wherein the pixel driving circuit comprises: a data line, a gate line, a first power line, a second power line, a reference signal line, a light emitting device, a driving transistor, a storage capacitor, a reset subcircuit, a data writing subcircuit, a compensation subcircuit and a light emitting control subcircuit, wherein:

the data line is configured to provide a data voltage;

the gate line is configured to provide a scanning voltage;

the first power line is configured to provide a first power voltage, the second power line is configured to provide a second power voltage, and the reference signal line is configured to provide a reference voltage;

the reset subcircuit is connected with two terminals of the storage capacitor, and also with the first power line, and the reset subcircuit is configured to reset a voltage across the two terminals of the storage capacitor to a predetermined signal voltage;

the data writing subcircuit is connected with the gate line, the data line and a second terminal of the storage capacitor, and the data writing subcircuit is configured to write information comprising the data voltage to the second terminal of the storage capacitor;

the compensation subcircuit is connected with a first terminal of the storage capacitor and the driving transistor, and the compensation subcircuit is configured to write information comprising a threshold voltage of the driving transistor and the first power voltage to the first terminal of the storage capacitor;

the light emitting control subcircuit is connected with the reference signal line, the second terminal of the storage capacitor, the driving transistor and the light emitting device, and the light emitting control subcircuit is configured to write the reference voltage to the second terminal of the storage capacitor;

the first terminal of the storage capacitor is connected with a gate of the driving transistor, and the storage capacitor is configured to transfer information comprising the data voltage to the gate of the driving transistor; and the driving transistor is connected with the first power line, the light emitting device is connected with the second power line, and the driving transistor is configured to drive the light emitting device to emit light, wherein the reset subcircuit comprises a reset control line, a reset signal line, a first transistor and a second transistor; a gate of the first transistor and a gate of the second transistor are both connected with the reset control line, a source of the first transistor is connected with the reset signal line, a drain of the first transistor is connected with the first terminal of the storage capacitor, a source of the second transistor is connected with the first power line, a drain of the second transistor is connected with the second terminal of the storage capacitor, and the first transistor and the second transistor are respectively configured to write the voltage of the reset signal line to the first terminal of the storage capacitor and to write the first power voltage to the second terminal of the storage capacitor both under control of the reset control line, wherein the reset signal line, the first power line and the reference signal line are three different signal lines, and the voltage of the reset signal line is a low voltage and is different from the first power voltage of the first power line and is different from the reference voltage of the reference signal line, the method comprising the following steps:

during a reset phase, the reset subcircuit resets the voltage across the storage capacitor to the predetermined signal voltage;

during a data voltage writing phase, the data writing subcircuit writes the data voltage and the compensation subcircuit writes the information comprising the threshold voltage of the driving transistor and the first power voltage to the two terminals of the storage capacitor respectively; and during a light emitting phase, the driving transistor drives the light emitting device to emit light under control of the light emitting control subcircuit.

14. The method according to claim 13, wherein during the reset phase, the reset subcircuit resets the voltage of the first terminal of the storage capacitor to the voltage of the reset signal line, and the reset subcircuit resets the voltage of the second terminal of the storage capacitor to the first power voltage.

15. The method according to claim 13, wherein during the data voltage writing phase, the data writing subcircuit writes the data voltage to the second terminal of the storage capacitor, and the compensation subcircuit writes information comprising the threshold voltage of the driving transistor and the first power voltage to the first terminal of the storage capacitor.

16. The method according to claim 13, wherein the light emitting control subcircuit writes the reference voltage to the second terminal of the storage capacitor, the storage capacitor transfers information comprising the data voltage and the reference voltage to the gate of the driving transistor, and the driving transistor drives the light emitting device to emit light under the control of the light emitting control subcircuit.

17. An array substrate comprising the pixel driving circuit according to claim 1.

18. A display apparatus comprising the array substrate according to claim 17.

19. The method according to claim 14, wherein during the data voltage writing phase, the data writing subcircuit writes the data voltage to the second terminal of the storage capacitor, and the compensation subcircuit writes information comprising the threshold voltage of the driving transistor and the first power voltage to the first terminal of the storage capacitor.

* * * * *